US010773300B2

(12) United States Patent
Tomita et al.

(10) Patent No.: US 10,773,300 B2
(45) Date of Patent: Sep. 15, 2020

(54) CASTING APPARATUS AND CASTING METHOD

(71) Applicant: TOYOTA JIDOSHA KABUSHIKI KAISHA, Toyota-shi, Aichi-ken (JP)

(72) Inventors: Takashi Tomita, Toyota (JP); Tadashi Nakahashi, Toyota (JP); Makoto Kikuchi, Nissin (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 230 days.

(21) Appl. No.: 15/877,645

(22) Filed: Jan. 23, 2018

(65) Prior Publication Data

US 2018/0214942 A1 Aug. 2, 2018

(30) Foreign Application Priority Data

Jan. 31, 2017 (JP) ..... 2017-015631

(51) Int. Cl.

| | |
|---|---|
| ***B22C 9/10*** | (2006.01) |
| ***B22D 29/00*** | (2006.01) |
| ***B22D 29/04*** | (2006.01) |
| ***B22C 23/00*** | (2006.01) |
| ***B22D 18/04*** | (2006.01) |
| ***B22D 17/20*** | (2006.01) |

(52) U.S. Cl.

CPC ..... *B22D 29/04* (2013.01); *B22C 9/108* (2013.01); *B22C 23/00* (2013.01); *B22D 17/2084* (2013.01); *B22D 18/04* (2013.01); *B22D 29/00* (2013.01); *B22D 29/001* (2013.01)

(58) Field of Classification Search

CPC .. B22C 9/10; B22C 9/108; B22C 9/23; B22D 29/00; B22D 29/001; B22D 29/04

See application file for complete search history.

(56) References Cited

U.S. PATENT DOCUMENTS

| | | | | | |
|---|---|---|---|---|---|
| 5,730,200 | A * | 3/1998 | Landua | B22C 9/108 | 164/137 |
| 5,855,468 | A * | 1/1999 | Cagle | B22C 9/108 | 164/224 |
| 2004/0211543 | A1* | 10/2004 | Wick | B22C 9/108 | 164/137 |
| 2006/0157217 | A1 | 7/2006 | Bassi | | |

FOREIGN PATENT DOCUMENTS

| | | |
|---|---|---|
| CN | 204449263 U | 7/2015 |
| JP | 2012-179643 A | 9/2012 |

* cited by examiner

*Primary Examiner* — Kevin E Yoon
(74) *Attorney, Agent, or Firm* — Oliff PLC

(57) ABSTRACT

A casting apparatus includes: a mold including a first mold segment and a second mold segment; and a transfer device that is configured to transfer a core to the first mold segment and place the core in the first mold segment, and to receive and transfer a casting. The transfer device includes a support part, a robot arm, a core grasping mechanism being provided on the support part, and a casting receiving part being provided on the support part. The transfer device is configured such that the robot arm moves the core grasping mechanism so as to place the core in the first mold segment, and moves the casting receiving part so as to receive the casting by the casting receiving part.

20 Claims, 18 Drawing Sheets

CASTING APPARATUS AND CASTING METHOD

INCORPORATION BY REFERENCE

The disclosure of Japanese Patent Application. No. 2017-015631 filed on Jan. 31, 2017 including the specification, drawings and abstract is incorporated herein by reference in its entirety.

BACKGROUND

1. Technical Field

The present disclosure relates to a casting apparatus and a casting method.

2. Description of Related Art

Casting requires performing various steps, including a step of placing a core inside a mold and a step of ejecting a casting. Japanese Patent Application Publication No. 2012-179643 discloses a technique related to a casting ejection and core setting apparatus that places a core and ejects a casting during casting.

Specifically, according to the technique disclosed in JP 2012-179643 A, the casting ejection and core setting apparatus includes an air blow mechanism, and casting holding means and core holding means that are provided on a leading end arm (rotating shaft) of an articulated robot. After a casting is held by the casting holding means, compressed air is discharged from an air nozzle constituting the air blow mechanism, and thereby a mold is cleaned. Then, the leading end arm is rotated, so that a core held by the core holding means is set in the mold.

SUMMARY

As described in Description of Related Art, the technique disclosed in JP 2012-179643 A employs the casting ejection and core setting apparatus to eject a casting from a lower mold segment and place a core in the lower mold segment.

The casting ejection and core setting apparatus disclosed in JP 2012-179643 A rotates the leading end arm after holding the casting placed in the lower mold segment by the casting holding means, and then sets the core held by the core holding means in the lower mold segment. Thus, the technique disclosed in JP 2012-179643 A involves rotating the leading end arm of the articulated robot, which adds to the casting cycle time.

The present disclosure provides a casting apparatus and a casting method that can reduce casting cycle time.

A first aspect of the present disclosure relates to a casting apparatus. This casting apparatus includes: a mold including a first mold segment and a second mold segment; and a transfer device that is configured to transfer a core to the first mold segment and place the core in the first mold segment, and to receive a casting that has been cast with the mold from the mold and transfer the casting. The transfer device includes a support part including a first side and a second side that is the opposite side of the support part from the first side, a robot arm, a core grasping mechanism being provided on the first side, and a casting receiving part being provided on the second side. The casting is held in the second mold segment when the mold is opened after casting. The transfer device is configured such that, in a state where the mold is open, the robot arm moves the core grasping mechanism grasping the core, so as to place the core in the first mold segment, and moves the casting receiving part so as to receive the casting held in the second mold segment, by the casting receiving part.

In the first aspect according to the present disclosure, the first mold segment may be a lower mold segment and the second mold segment may be an upper mold segment.

In the first aspect according to the present disclosure, the transfer device may be configured such that, in a state where the mold is open, the robot arm moves the core grasping mechanism to the vertically upper side of the lower mold segment and moves the casting receiving part to the vertically lower side of the upper mold segment.

In the first aspect according to the present disclosure, the casting receiving part may include a column member including a first end and a second end, and a plurality of plate members. The first end may be in contact with the second side, and the second end may be located at a position away from the second side in a direction from the first side toward the second side. The plurality of plate members may each include one end in contact with the second end and another end. The plurality of plate members may be parallel to the plane of the support part. The other ends of the plurality of plate members may extend away from the second end in the same direction so as to form a fork shape.

In the first aspect according to the present disclosure, the transfer device may include a sand receiving member between the support part and the casting receiving part in a direction perpendicular to the plane of the second side, and the sand receiving member may be configured to receive sand falling from the core that is contained in the casting placed on the casting receiving part.

In the first aspect according to the present disclosure, the casting receiving part may include a hole corresponding to a projection that is provided on a surface of the casting coining in contact with the first mold segment.

In the first aspect according to the present disclosure, the core grasping mechanism may include a picker that is in contact with the first side and extends in a direction from the second side toward the first side. The picker may include a grasping part configured to be expandable and contractible with a fluid, and the core grasping mechanism may be configured to grasp the core by expanding the grasping part.

In the first aspect according to the present disclosure, the casting apparatus may further include a holding furnace that is configured to hold molten metal. The holding furnace may be hermetically closed and communicate with the inside of the mold, and the holding furnace may be configured such that the molten metal is supplied to the inside of the mold as the pressure inside the holding furnace is raised higher than an atmospheric pressure.

In the first aspect according to the present disclosure, the second mold segment may include a cooling mechanism that is configured to cool the molten metal packed inside the mold.

In the first aspect according to the present disclosure, the transfer device may grasp the core by the core grasping mechanism that is provided on the lower side of the support part of the transfer device, and may transfer the core to above the lower mold segment and place the core in the lower mold segment. Moreover, the transfer device may receive the casting, held in the upper mold segment, by the casting receiving part that is provided on the upper side of the support part of the transfer device, and may transfer the received casting to the outside of the mold. Thus, it is possible to place the core in the lower mold segment and receive the casting from the upper mold segment as a sequence of actions. In addition, according to the first aspect of the present disclosure, it is possible to place the core and receive the casting without rotating the core grasping mechanism and the casting receiving part, i.e., without turning them upside down. Therefore, the casting cycle time can be reduced.

A second aspect according to the present disclosure relates to a casting method. This casting method includes: separating a first mold segment and a second mold segment from each other after casting; and after separating the first mold segment and the second mold segment from each other, moving the core grasping mechanism grasping the core, by a robot arm so as to place the core in the first mold segment. The support part has a first side and a second side that is the opposite side of the support part froth the first side, and the core grasping mechanism is provided on the first side. The casting method further includes moving a casting receiving part provided on the second side by the robot arm so as to receive the casting held in the second mold segment, by the casting receiving part.

In the second aspect according to the present disclosure, the first mold segment may be a lower mold segment and the second mold segment may be an upper mold segment.

In the second aspect according to the present disclosure, when placing the core in the lower mold segment, the robot arm may move the core grasping mechanism to a vertically upper side of the lower mold segment, and when the receiving the casting by the casting receiving part, the robot arm may move the casting receiving part to a vertically lower side of the upper mold segment.

In the second aspect according to the present disclosure, the casting may be received by the casting receiving part after the core is placed in the first mold segment.

In the second aspect according to the present disclosure, the core may be grasped by the core grasping mechanism that is provided on the lower side of the support part of the transfer device, and the core may be transferred to above the lower mold segment and placed in the lower mold segment. Moreover, the casting held in the upper mold segment may be received by the casting receiving part that is provided on the upper side of the support part of the transfer device. Thus, it is possible to place the core and receive the casting as a sequence of actions. In addition, according to the second aspect of the present disclosure, it is possible to place the core and receive the casting without rotating the core grasping mechanism and the casting receiving part, i.e., without turning them upside down. Therefore, the casting cycle time can be reduced.

The present disclosure can provide a casting apparatus and a casting method that can reduce casting cycle time.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Figure 1:
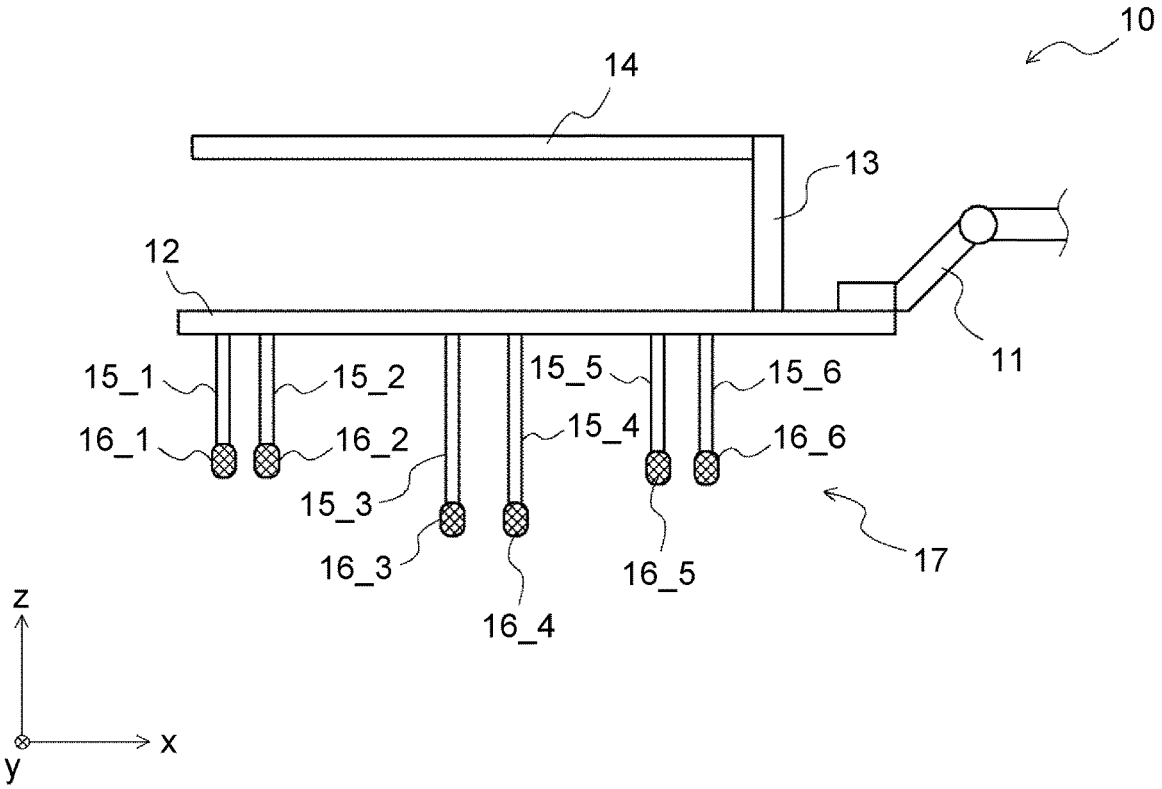
FIG. 1 is a front view showing a transfer device of a casting apparatus according to an embodiment.

An embodiment of the present disclosure will be described below with reference to the drawings. FIG. 1 is a front view showing a transfer device of a casting apparatus according to the embodiment. A transfer device 10 shown in FIG. 1 is a device that transfers a core to a mold of the casting apparatus and places the core in the mold, and receives a casting that has been cast with the mold from the mold and transfers the casting (see FIG. 9E to FIG. 9I).

As shown in FIG. 1, the transfer device 10 includes a robot arm 11, a support part 12, a column member 13, a casting receiving part 14, pickers 15_1 to 15_6, and grasping parts 16_1 to 16_6. The support part 12 has a first side and a second side that is the opposite side of the support part 12 from the first side. The column member 13 and the casting receiving part 14 are disposed on an upper side of the support part 12 (the second side; a plus side in a z-axis direction). The pickers 15_1 to 15_6 and the grasping parts 16_1 to 16_6 are disposed on a lower side of the support part 12 (the first side; a minus side in the z-axis direction), and constitute a core grasping mechanism 17.

The robot arm 11 is configured to be able to move the support part 12 in x-, y-, and z-axis directions. For example, the robot arm 11 moves the support part 12 in a state where a principal surface (a surface parallel to an xy-plane) of the support part 12 is kept parallel to a horizontal plane (xy-plane).

The pickers 15_1 to 15_6 are provided so as to extend downward from a lower surface of the support part 12. The pickers 15_1 to 15_6 extend from the first side in a direction from the second side toward the first side. The grasping parts 16_1 to 16_6 are respectively provided at leading ends of the pickers 15_1 to 15_6. The grasping parts 16_1 to 16_6 are configured to be expandable and contractible with a fluid such as a gas or a liquid, and for example, can be formed by an elastic member such as rubber, for example, rubber balloons. In the following, a case where a gas is used as the fluid will be described as an example. The grasping parts 16_1 to 16_6 are each supplied with the gas (compressed air) through a pipe (riot shown).

Figure 2:
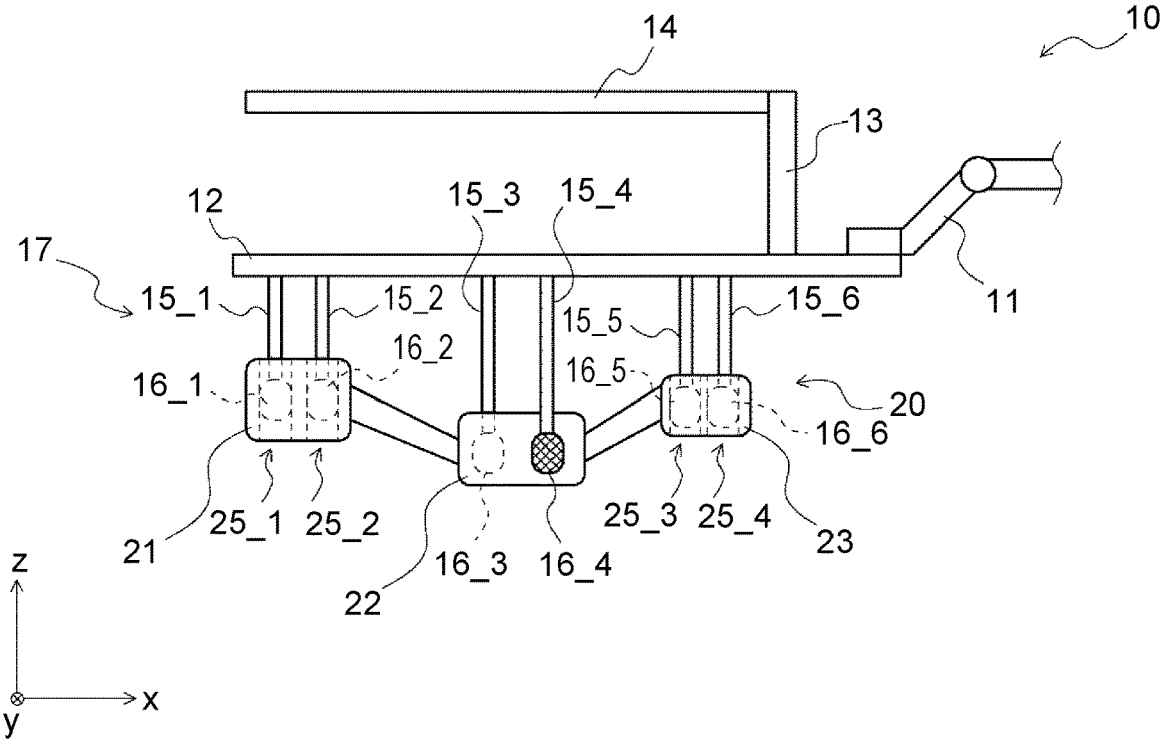
FIG. 2 is a front view showing a state where the transfer device shown in FIG. 1 is grasping a core.
Figure 3:
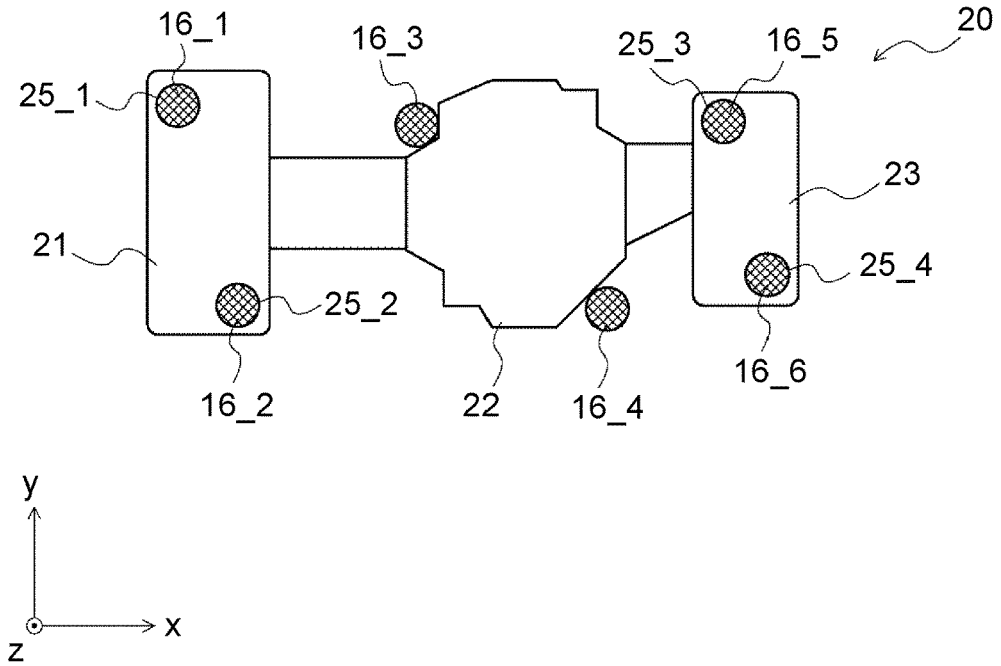
FIG. 3 is a top view showing the state where the transfer device shown in FIG. 1 is grasping the core.

FIG. 2 and FIG. 3 are respectively a front view and a top view showing a state where the transfer device 10 is grasping a core 20. In the example shown in FIG. 2 and FIG. 3, the grasping parts 16_1 to 16_6 of the six pickers 15_1 to 15_6 are grasping the core 20 that has first to third parts 21 to 23.

Specifically, the grasping parts 16_1, 16_2 grasp the first part 21 of the core 20 by expanding inside grasping holes 25_1, 25_2 that are formed in the first part 21 of the core 20. The grasping parts 16_3, 16_4 grasp the second part 22 of the core 20 by expanding and coming in contact with side surfaces of the second part 22 of the core 20. The grasping parts 16_5, 16_6 grasp the third part 23 of the core 20 by expanding inside grasping holes 25_3, 25_4 that are formed in the third part 23 of the core 20. If the core 20 is thus grasped by expanding the grasping parts 16_1 to 16_6, the core 20 can be grasped with the grasping parts 16_1 to 16_6 in surface contact with the core 20, which can avoid damage to the core 20 while the core 20 is grasped, For example, supplying compressed air at a predetermined pressure to the grasping parts 16_1 to 16_6 can expand the grasping parts 16_1 to 16_6. The compressed air is supplied from a compressor etc. (not shown) to the grasping parts 16_1 to 16_6 through the pipes (not shown). When the grasping parts 16_1 to 16_6 are expanded and grasping the core 20, opening an air release valve (not shown) of the pipes leading to the grasping parts 16_1 to 16_6 can contract the grasping parts 16_1 to 16_6. Thus, the core can be released from the grasp of the grasping parts 16_1 to 16_6.

The shape of the core 20 and the arrangement of the pickers 15_1 to 15_6 and the grasping parts 16_1 to 16_6 shown in FIG. 2 and FIG. 3 are examples, and the shape of the core and the arrangement of the pickers in this embodiment may be different from these examples. The configuration including the pickers 15_1 to 15_6 and the grasping parts 16_1 to 16_6 has been shown above as the configuration of the core grasping mechanism 17. However, the core grasping mechanism 17 in this embodiment is not limited to this configuration, and may have any configuration that allows the core grasping mechanism 17 to grasp the core 20.

Figure 4:
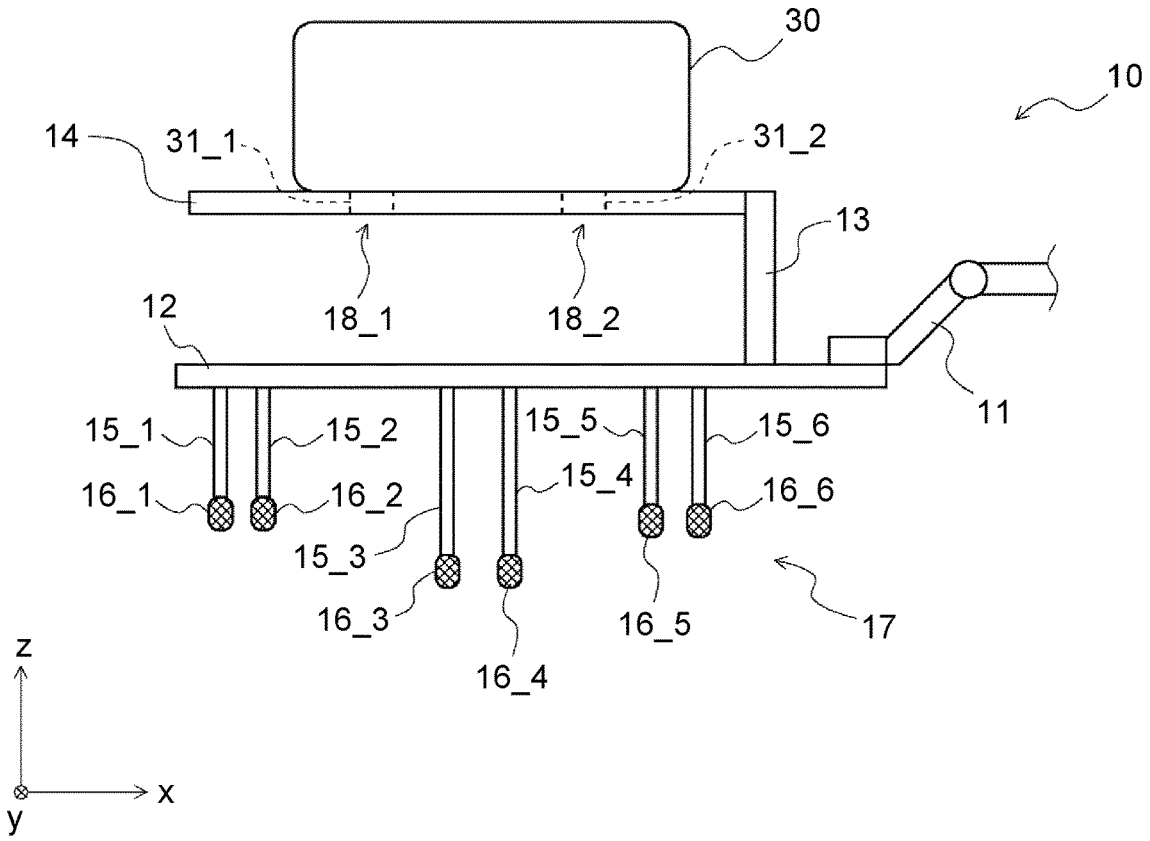
FIG. 4 is a front view showing a state where the transfer device shown in FIG. 1 is receiving a casting.
Figure 5:
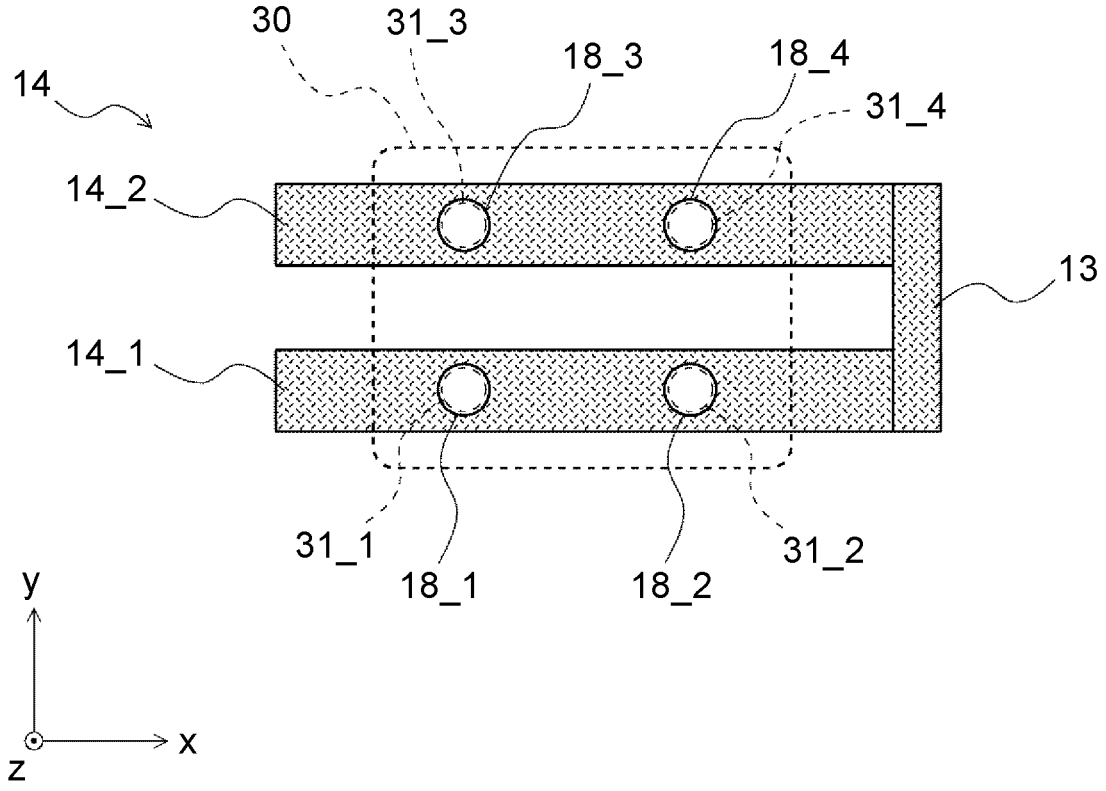
FIG. 5 is a top view illustrating details of a casting receiving part of the transfer device shown in FIG. 1.

As shown in FIG. 4, the transfer device 10 includes the casting receiving part 14 on the upper side of the support part 12. A casting 30 is placed on an upper surface of the casting receiving part 14. The casting receiving part 14 is fixed to the column member 13 that extends upward from an upper surface of the support part 12. The column member 13 includes a first end and a second end, with the first end in contact with the second side. The second end is located at a position away from the second side in a direction from the first side toward the second side. The casting receiving part 14 is formed by a plate member of which one end is supported by the column member 13 and which extends in a horizontal direction (a direction from the column member 13 toward a minus side in the x-axis direction). Thus, the plate member includes the one end in contact with the second end, and is parallel to the plane of the support part. While the plate member may be one sheet of plate, the casting receiving part 14 in this embodiment may be composed of a plurality of plate members 14_1, 14_2 as shown in FIG. 5. Specifically, the plurality of plate members 14_1, 14_2 extend from the column member 13 in the same direction (the direction from the column member 13 toward the minus side in the x-axis direction) in the same horizontal plane (xy-plane) so as to form a fork shape. In other words, the other ends of the plurality of plate members 14_1, 14_2 extend away from the second end in the same direction so as to form a fork shape.

Surfaces of the plate members may have any shape that allows the casting 30 to be placed thereon, for example, a flat shape. In this embodiment, however, as shown in FIG. 5, holes 18_1 to 18_4 may be formed in the plurality of plate members 14_1, 14_2 composing the casting receiving part 14, at positions corresponding to projections 31_1 to 31_4 that are formed on a lower surface of the casting 30. The projection is provided on a surface of the casting 30 coming in contact with the first mold segment. If the holes 18_1 to 18_4 are thus provided in the plate members 14_1, 14_2, the projections 31_1 to 31_4 on the lower surface of the casting 30 are inserted into the holes 18_1 to 18_4 when the casting 30 is placed on the plate members 14_1, 14_2, which allows the casting 30 to be stably transferred.

Figure 6A:
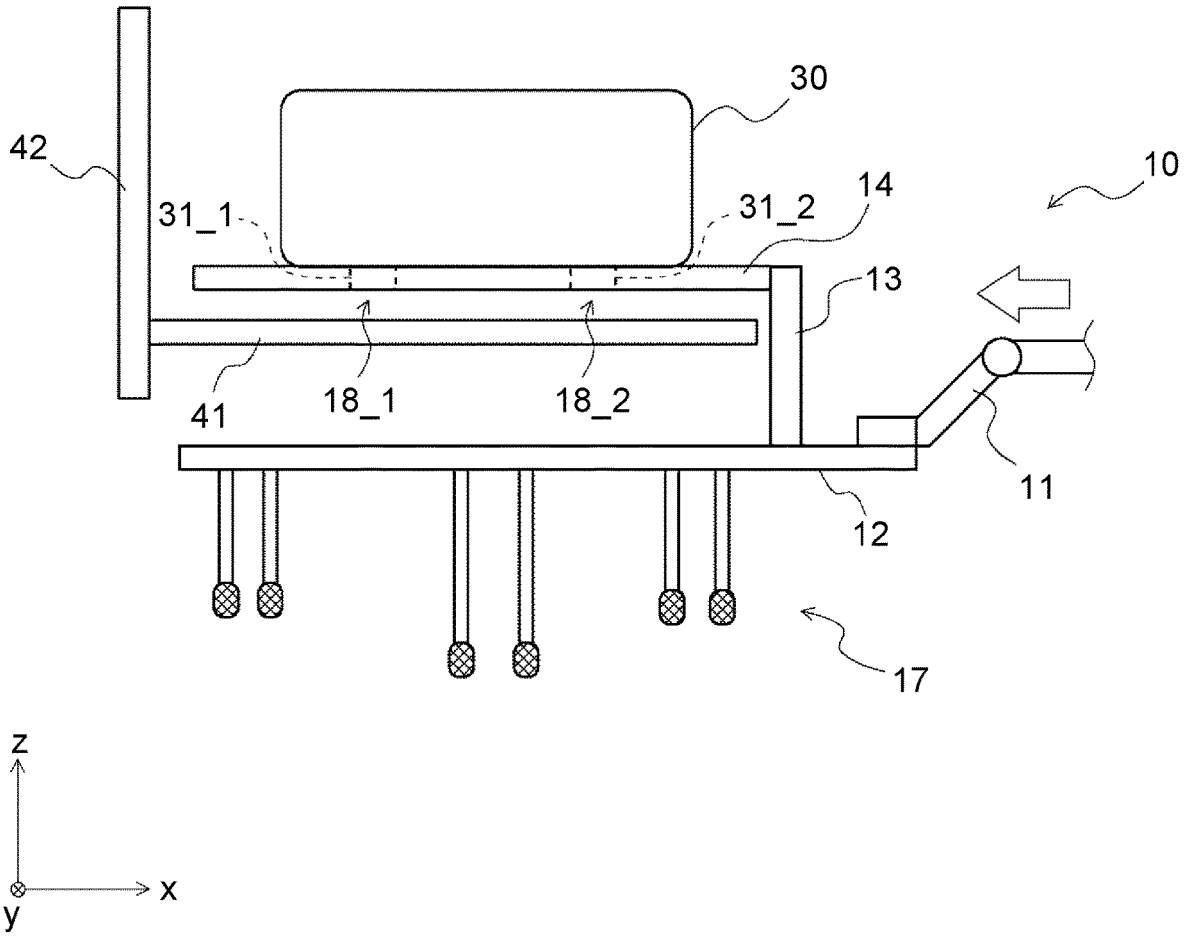
FIG. 6A is a front view illustrating an action of the transfer device shown in FIG. 1 placing the casting onto a table.
Figure 6B:
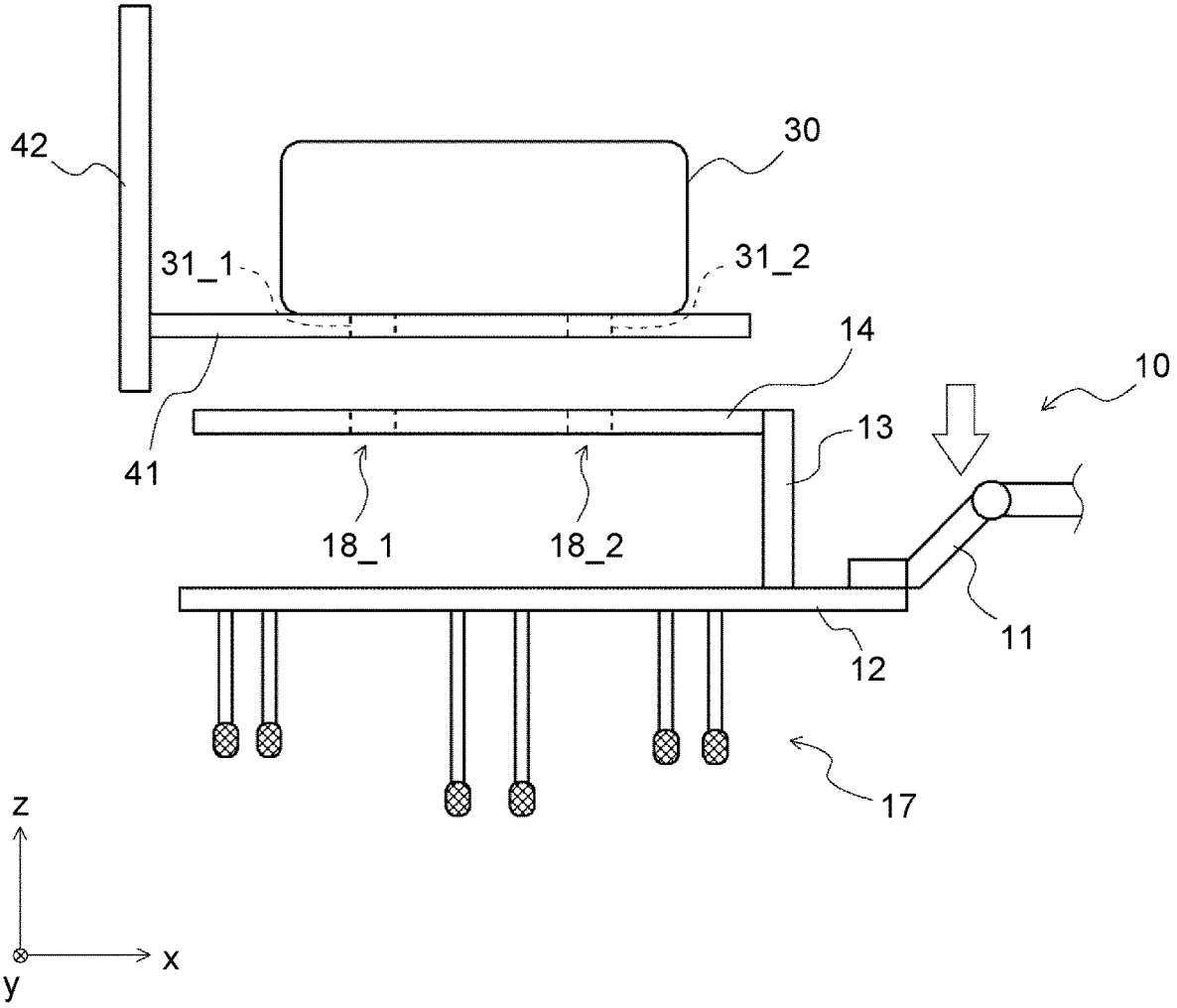
FIG. 6B is a front view showing the action of the transfer device shown in FIG. 1 placing the casting onto the table.
Figure 7:
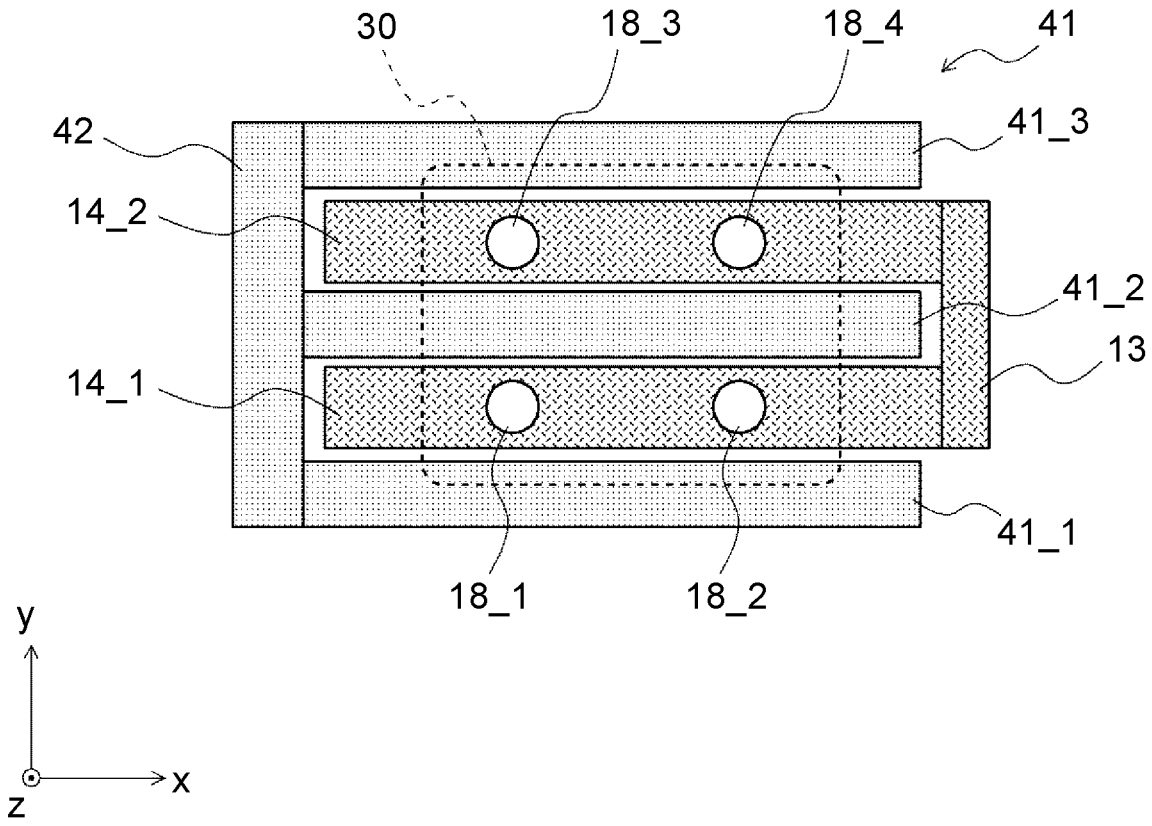
FIG. 7 is a top view illustrating a positional relation between the casting receiving part of the transfer device and the table.

FIG. 6A and FIG. 6B are front views illustrating an action of the transfer device 10 placing the casting 30 onto a table 41. The table 41 shown in FIG. 6A and FIG. 6B is provided in the vicinity of a casting apparatus 1 (see FIG. 8), and serves as a base on which the casting 30 having been cast by the casting apparatus 1 is temporarily placed. As shown in FIG. 6A and. FIG. 6B, the table 41 is supported by a support member 42 that extends in a vertical direction (z-axis direction). As shown in FIG. 7, the table 41 is composed of a plurality of plate members 41_1 to 41_3 that extend in the x-axis direction. The plate members 41_1 to 41_3 each have one end fixed to the support member 42. The plate members 14_1, 14_2 composing the casting receiving part 14 and the plate members 41_1 to 41_3 composing the table 41 are disposed alternately while facing each other when seen from above.

To move the casting 30 placed on the casting receiving part 14 of the transfer device 10 onto the table 41, first, as shown in FIG. 6A, the support part 12 is moved by the robot arm 11 so that the casting receiving part 14 with the casting 30 placed thereon is disposed above the table 41. At this point, the casting receiving part 14 is disposed so that the plate members 14_1, 14_2 composing the casting receiving part 14 and the plate members 41_1 to 41_3 composing the table 41 are disposed alternately when seen from above (see FIG. 7).

Then, as shown in FIG. 6B, the support part 12 is moved downward (toward the minus side in the z-axis direction) by the robot arm 11. Thus, the plate members 14_1, 14_2 composing the casting receiving part 14 respectively pass through gaps between the plate members 41_1 to 41_3 composing the table 41, so that the casting 30 placed on the casting receiving part 14 is moved onto the table 41.

Thus, in this embodiment, the plate members 14_1, 14_2 composing the casting receiving part 14 and the plate members 41_1 to 41_3 composing the table 41 are disposed alternately when seen from above. As the plate members 141, 142 composing the casting receiving part 14 respectively pass through the gaps between the plate members 41_1 to 41_3 composing the table 41, the casting 30 placed on the casting receiving part 14 is moved onto the table 41.

Since it is thus possible to move the casting 30 onto the table 41 without the need for a mechanism that lifts up the casting 30 from the casting receiving part 14 and moves the casting 30 onto the table 41, the facility cost can be reduced and a small-footprint facility can be realized.

Figure 8:
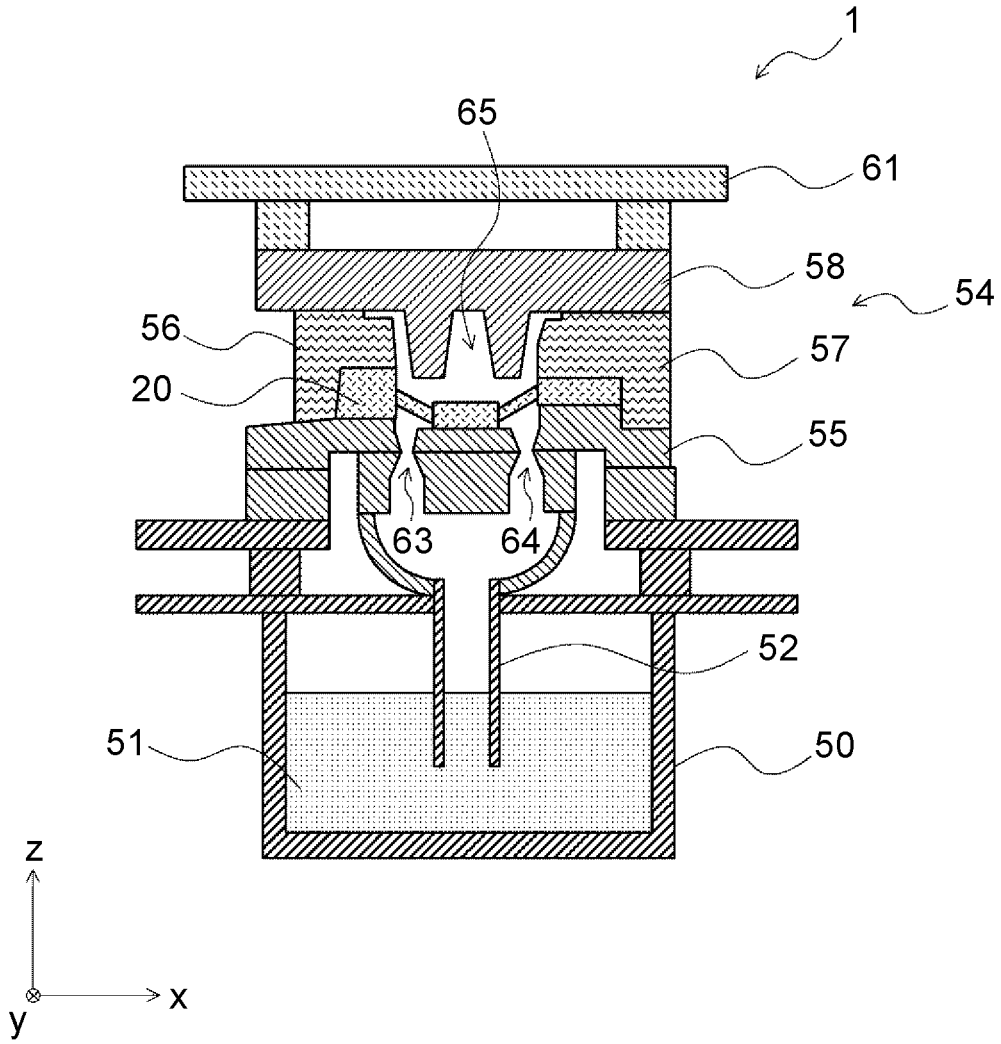
FIG. 8 is a sectional view showing a casting apparatus according to the embodiment.

Next, the casting apparatus 1 according to this embodiment will be described using the sectional view shown in FIG. 8. As shown in FIG. 8, the casting apparatus 1 according to this embodiment includes a holding furnace 50, a stalk 52, the lower mold segment 55, lateral mold segments 56, 57, an upper mold segment 58, and a lifting mechanism 61. The casting apparatus 1 according to this embodiment is typically a low-pressure casting apparatus.

Molten metal 51 is held in the holding furnace 50. A lower end of the stalk 52 is immersed in the molten metal 51. The lower mold segment 55, the lateral mold segments 56, 57, and the upper mold segment 58 compose a mold 54 of the casting apparatus 1 according to this embodiment. While the configuration including the lateral mold segments 56, 57 is shown as an example in FIG. 8, the casting apparatus 1 according to this embodiment should at least include the upper mold segment 58 (second mold segment) and the lower mold segment 55 (first mold segment), and the lateral mold segments 56, 57 may be omitted.

The core 20 is disposed inside a cavity 65 formed by the lower mold segment 55, the lateral mold segments 56, 57, and the upper mold segment 58. Gates 63, 64 are provided at a lower part of the cavity 65 (at a lower part of the lower mold segment 55). The holding furnace 50 and the cavity 65 spatially communicate with each other, and the molten metal 51 is supplied to the cavity 65 through the gates 63, 64. Specifically, the holding furnace 50 is hermetically closed, and the molten metal 51 rises up inside the stalk 52 and is supplied into the cavity 65 through the gates 63, 64 as the pressure inside the holding furnace 50 is raised.

Next, actions involved in casting using the casting apparatus 1 according to this embodiment will be described using FIG. 9A to FIG. 9J.

Figure 9A:
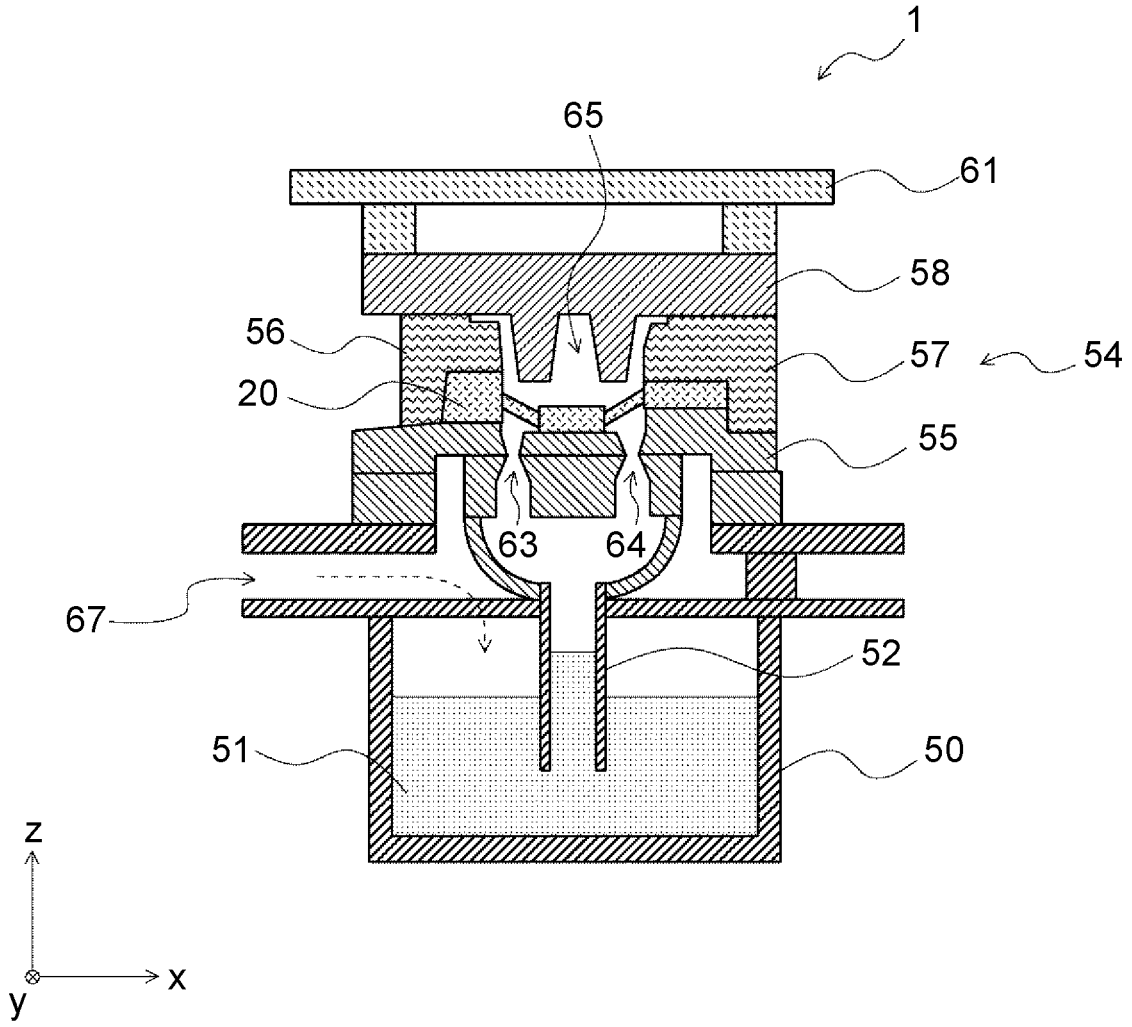
FIG. 9A is a sectional view illustrating a casting process using the casting apparatus according to the embodiment.

In casting, first, as shown in FIG. 9A, the pressure inside the holding furnace 50 is raised. Thus, the molten metal 51 held in the holding furnace 50 rises up inside the stalk 52. For example, an inert gas is supplied from a pressurizer (not shown) into the holding furnace 50 through a ventilation port 67 to thereby raise the pressure inside the holding furnace 50. Here, since the holding furnace 50 is hermetically closed, the molten metal 51 held in the holding furnace 50 rises up inside the stalk 52 as the pressure inside the holding furnace 50 rises.

Figure 9B:
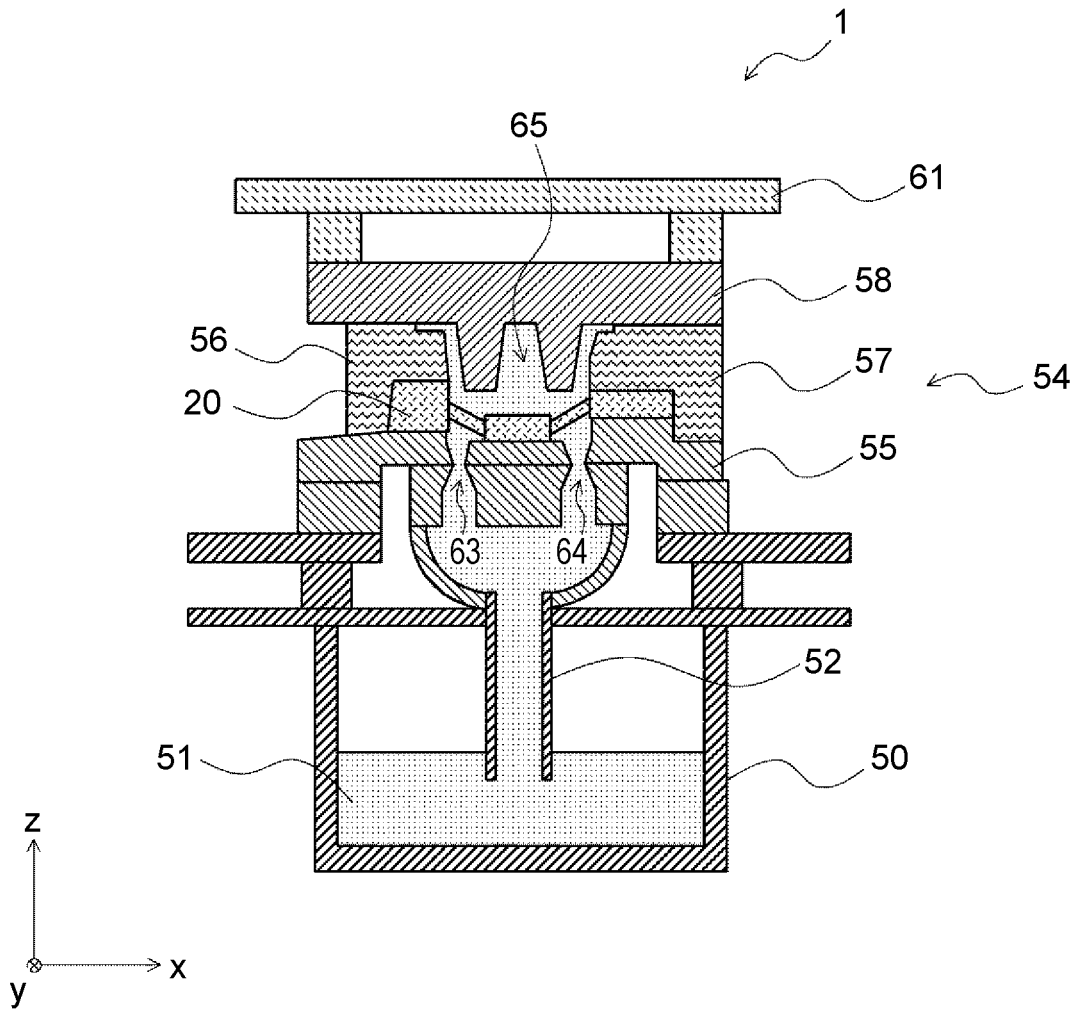
FIG. 9B is a sectional view illustrating the casting process using the casting apparatus according to the embodiment.

As shown in FIG. 9B, the pressure inside the holding furnace 50 is raised until the molten metal 51 held in the holding furnace 50 rises up inside the stalk 52, passes through the gates 63, 64, and is packed inside the cavity 65. Then, the pressure inside the holding furnace 50 is held, and the state shown in FIG. 9B is maintained for a certain time. Thus, the molten metal 51 packed inside the cavity 65 solidifies. For example, the upper mold segment 58 is provided with a cooling mechanism (not shown), and this cooling mechanism is used to solidify the molten metal packed inside the cavity 65 by cooling.

Figure 9C:
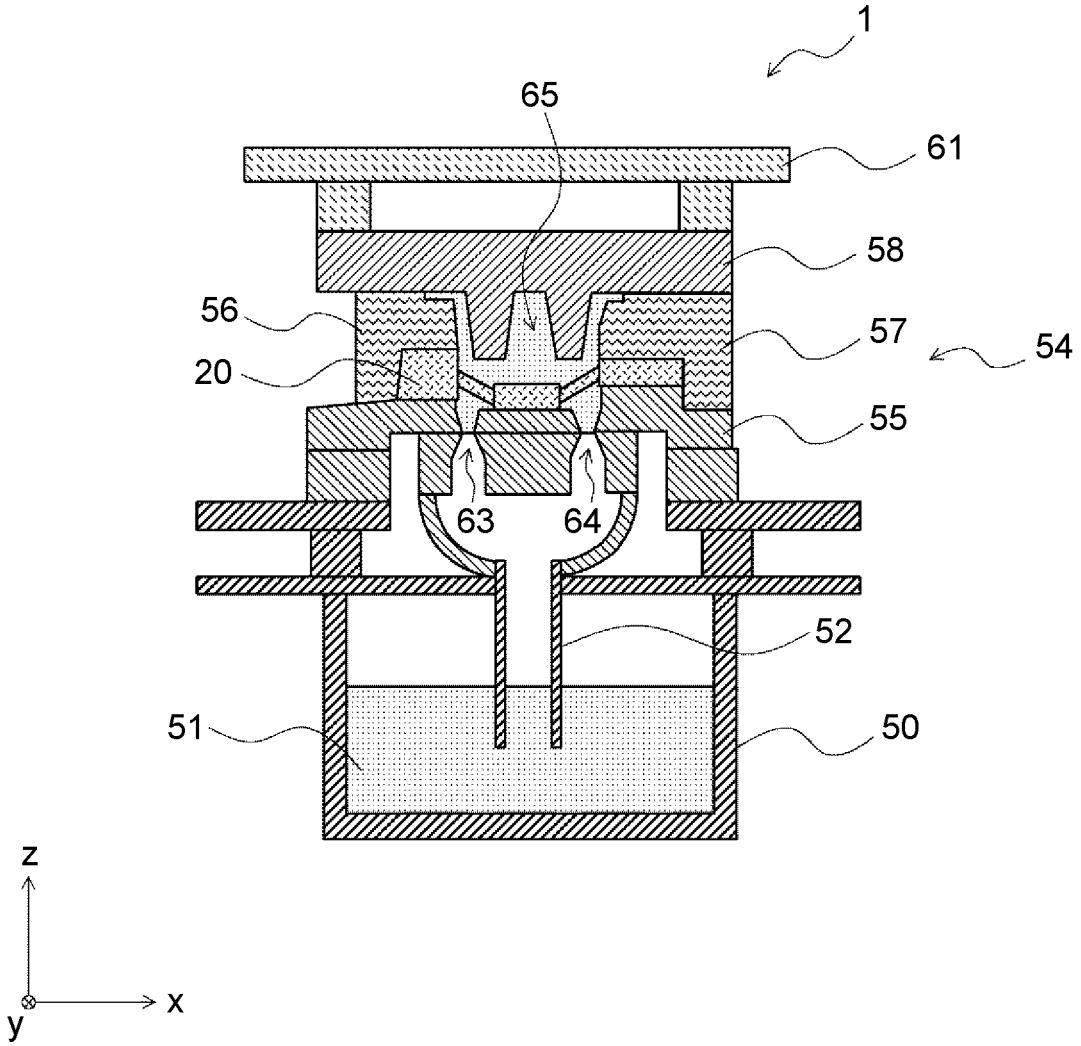
FIG. 9C is a sectional view illustrating the casting process using the casting apparatus according to the embodiment.
Figure 9D:
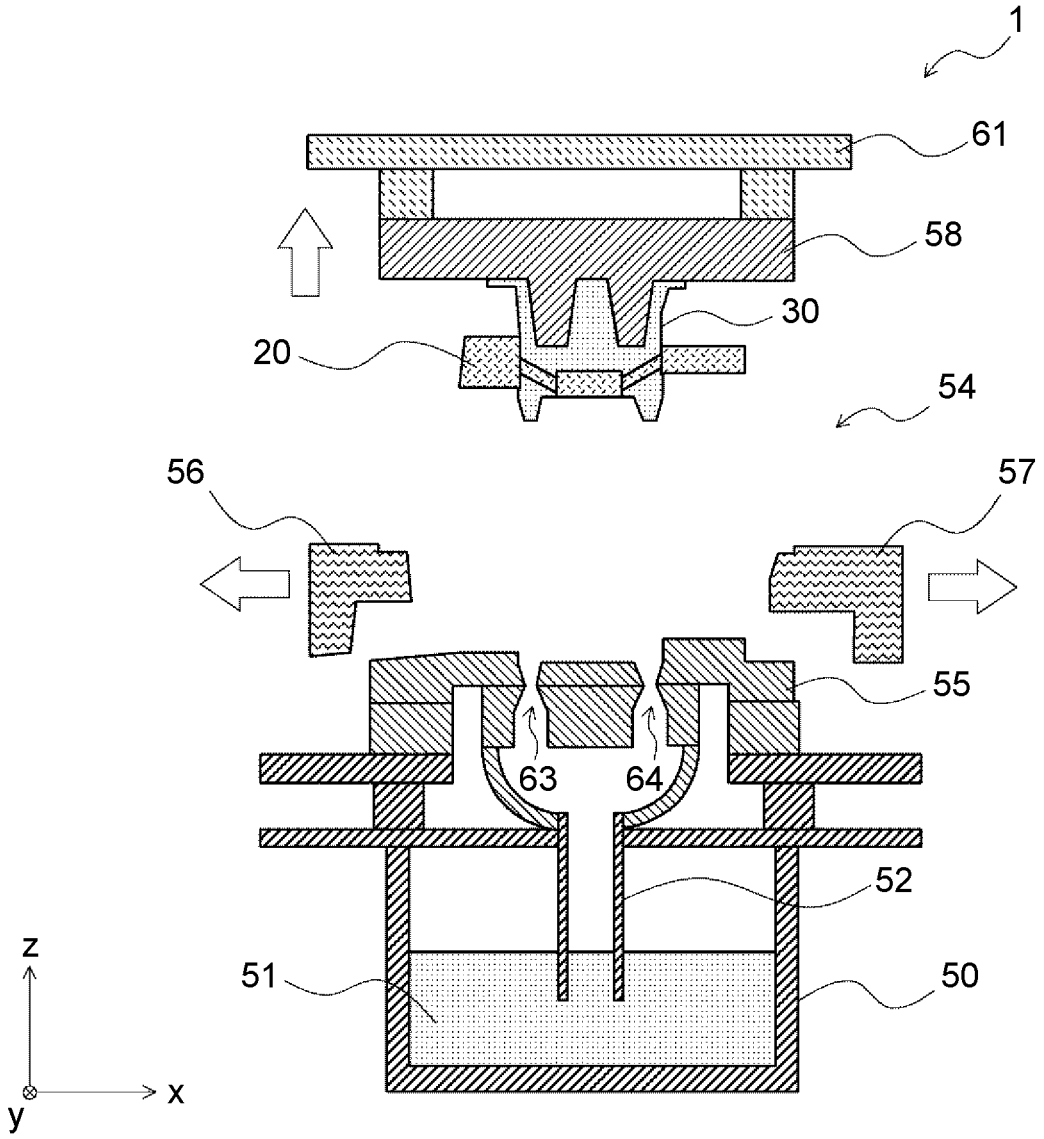
FIG. 9D is a sectional view illustrating the casting process using the casting apparatus according to the embodiment.

Next, the inert gas inside the holding furnace 50 is discharged to reduce the pressure inside the holding furnace 50 to a normal pressure. Thus, as shown in FIG. 9C, the molten metal 51 rising up inside the stalk 52 returns to the holding furnace 50. Then, as shown in FIG. 9D, the mold 54 is opened by moving the lateral mold segment 56 toward the minus side in the x-axis direction, the lateral mold segment 57 toward a plus side in the x-axis direction, and the upper mold segment 58 toward the plus side in the z-axis direction. At this point, the casting 30 having been cast is held in the upper mold segment. The casting 30 contains the core 20 that forms a hollow portion inside the casting 30.

Figure 9E:
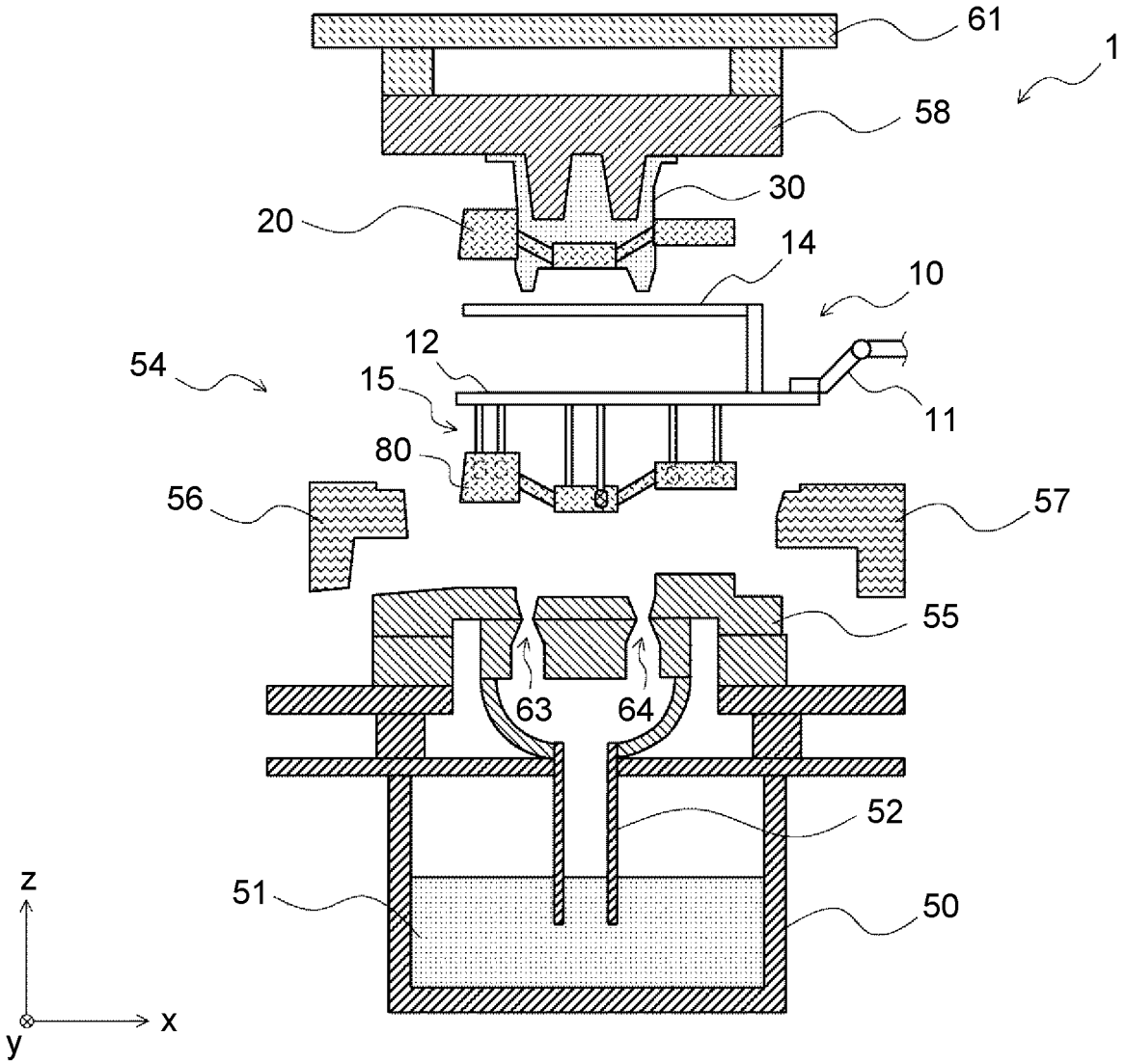
FIG. 9E is a sectional view illustrating the casting process using the casting apparatus according to the embodiment.

Then, as shown in FIG. 9E, in a state where the mold 54 is open, a core 80 is transferred to an upper side of the lower mold segment 55 by the transfer device 10. Here, the reference sign 80 denotes a core that is used in the next casting process. Specifically, the transfer device 10 disposes the pickers 15 (grasping parts 16) in the vicinity of the core 80 that is placed on a core table (not shown), and grasps the core 80 by expanding the grasping parts 16 (see FIG. 2 and FIG. 3). Then, in a state where the grasping parts 16 are expanded and grasping the core 80, the transfer device 10 moves the support part 12 by the robot arm 11, and transfers the core 80 to the upper side (vertically upper side) of the lower mold segment 55 (see FIG. 9E).

Figure 9F:
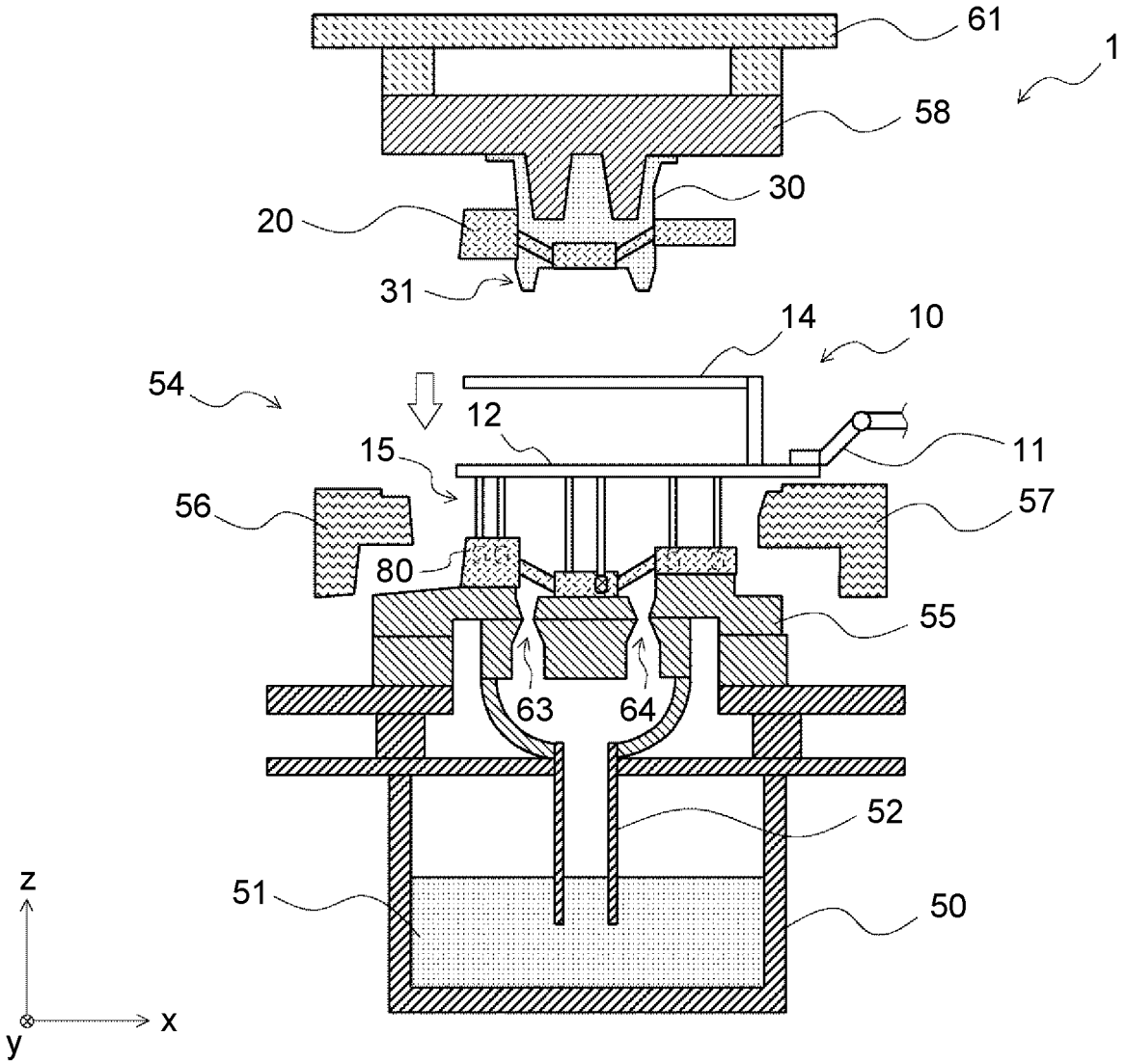
FIG. 9F is a sectional view illustrating the casting process using the casting apparatus according to the embodiment.

Then, as shown in FIG. 9F, the core 80 is moved downward by the robot arm 11, and the core 80 is placed on the lower mold segment 55. Then, the grasping parts 16 are contracted to release the core 80 from the grasp of the grasping parts 16. Thus, the core 80 has been placed on the lower mold segment 55.

Figure 9G:
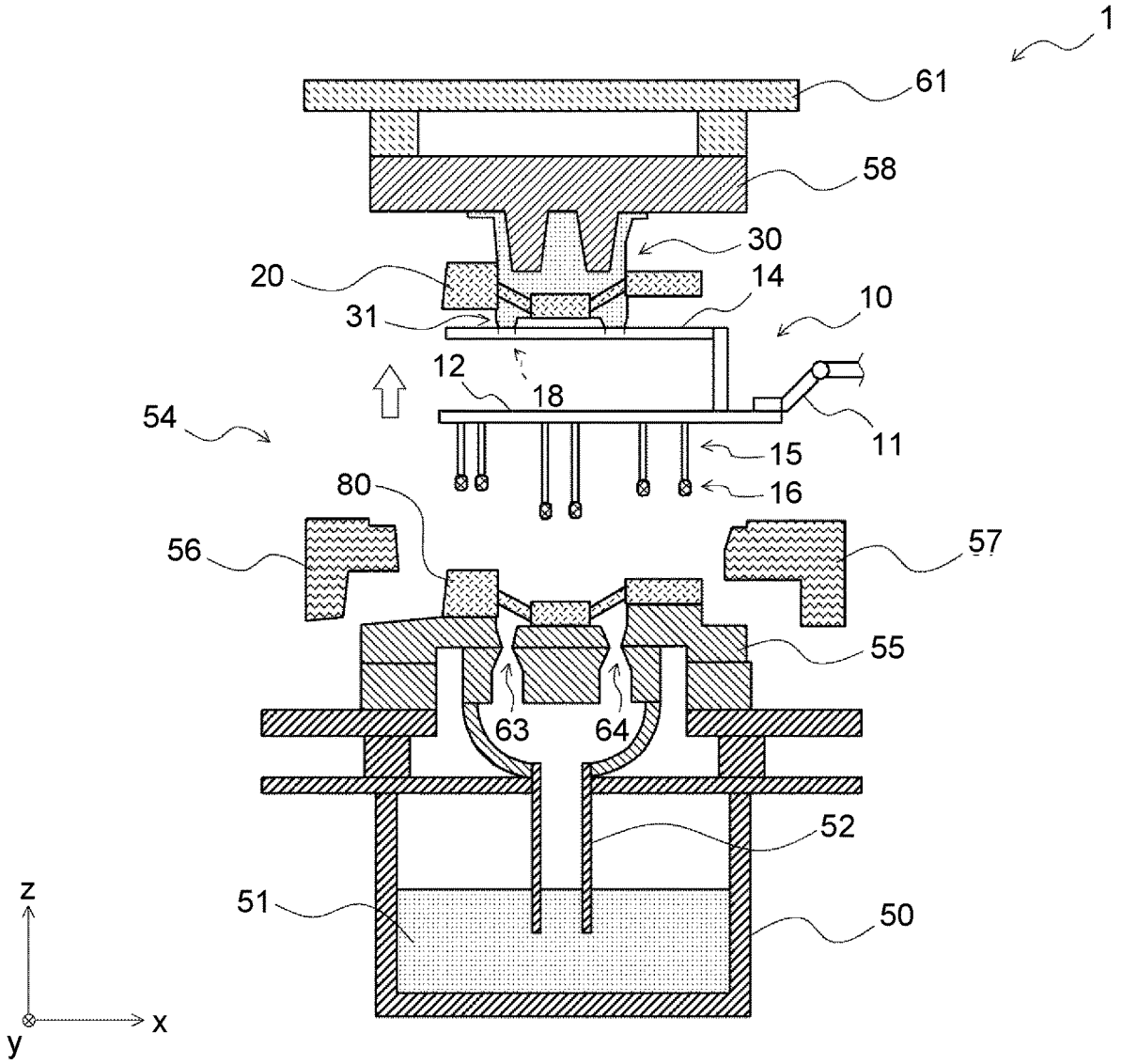
FIG. 9G is a sectional view illustrating the casting process using the casting apparatus according to the embodiment.

Then, as shown in FIG. 9G, the support part 12 is moved upward by the robot arm 11 so as to place the casting receiving part 14 on a lower side (vertically lower side) of the casting 30. At this point, the casting receiving part 14 is disposed so that the projections 31 formed on the lower surface of the casting 30 are inserted into the holes 18 formed in the casting receiving part 14 (for details, see FIG. 4 and FIG. 5). The projections 31 formed on the lower surface of the casting 30 correspond to the shapes of the gates 63, 64.

Figure 9H:
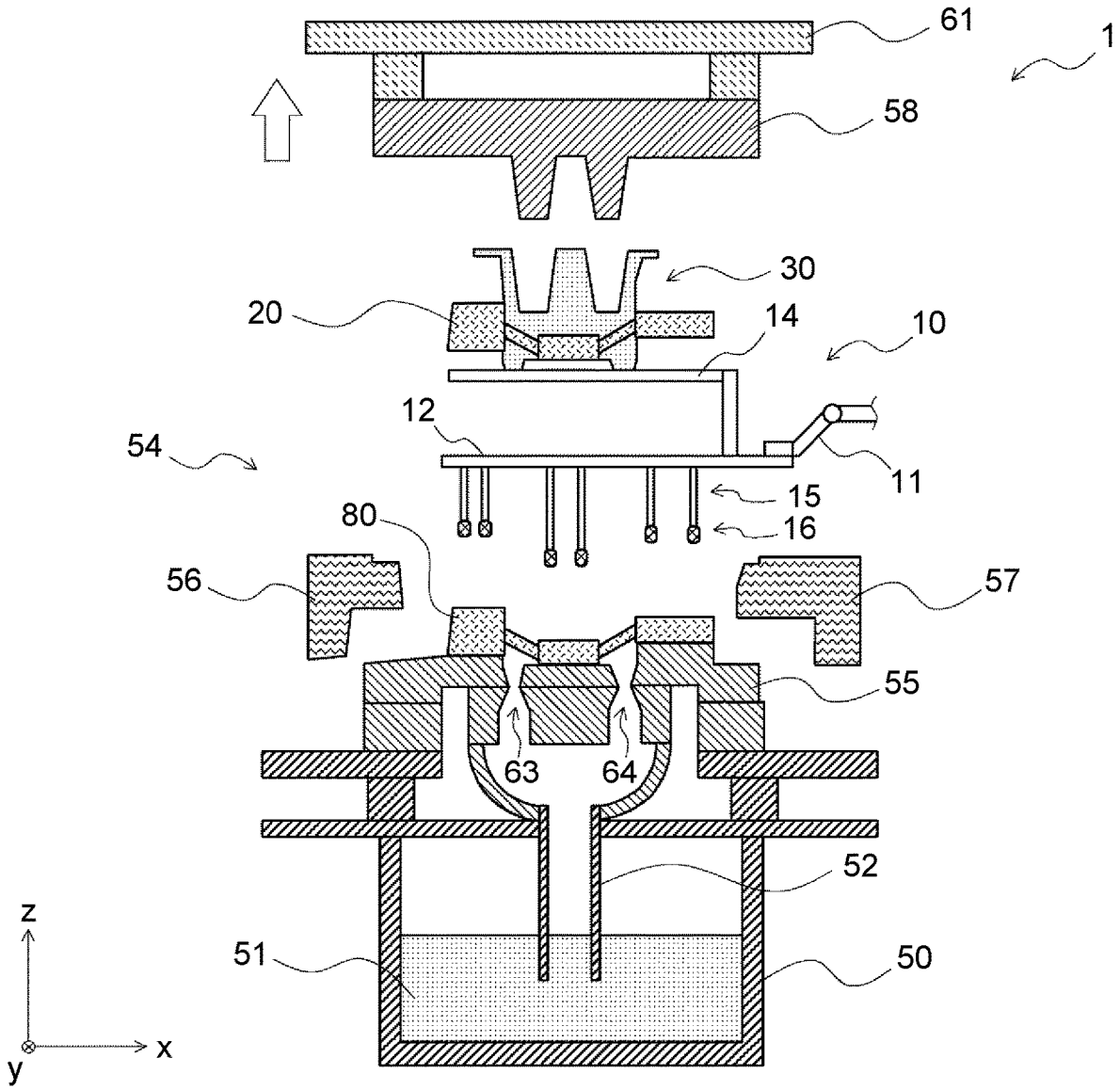
FIG. 9H is a sectional view illustrating the casting process using the casting apparatus according to the embodiment.

Then, as shown in FIG. 9H, the casting 30 is released from the mold, and the upper mold segment 58 is moved upward by the lifting mechanism 61. Thus, the casting 30 is released from the upper mold segment 58, and the casting 30 that has been held in the upper mold segment 58 can be received by the casting receiving part 14. To release the casting 30 from the upper mold segment 58, for example, an ejector pin (not shown) is used to push the casting 30 out of the upper mold segment 58.

Figure 9I:
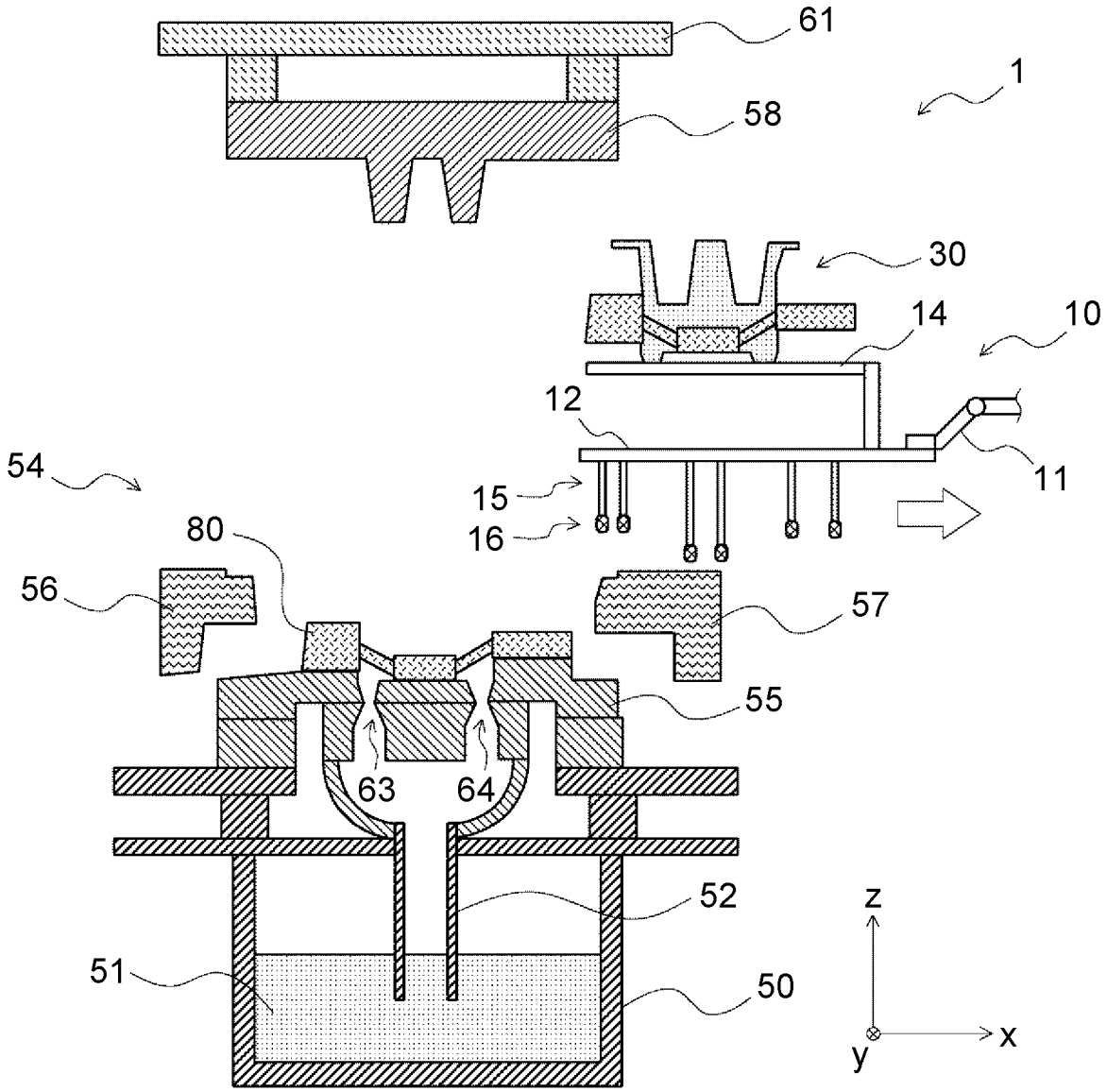
FIG. 9I is a sectional view illustrating the casting process using the casting apparatus according to the embodiment.

Then, as shown in FIG. 9I, in a state where the casting 30 is placed on the casting receiving part 14, the casting 30 is transferred to an outside of the mold 54 by the robot arm 11. As shown in FIG. 6A and FIG. 6B, the casting 30 is placed on the table 41 that is provided in the vicinity of the casting apparatus 1. Specifically, as shown in. FIG. 6A, the support part 12 is moved by the robot arm 11 so that the casting receiving part 14 with the casting 30 placed thereon is disposed above the table 41. Then, as shown in FIG. 6B, the support part 12 is moved downward (toward the minus side in the z-axis direction) by the robot arm 11. Thus, the plate members 14_1, 14_2 composing the casting receiving part 14 respectively pass through the gaps between the plate members 41_1 to 41_3 composing the table 41 (see FIG. 7), so that the casting 30 placed on the casting receiving part 14 is moved onto the table 41.

Figure 9J:
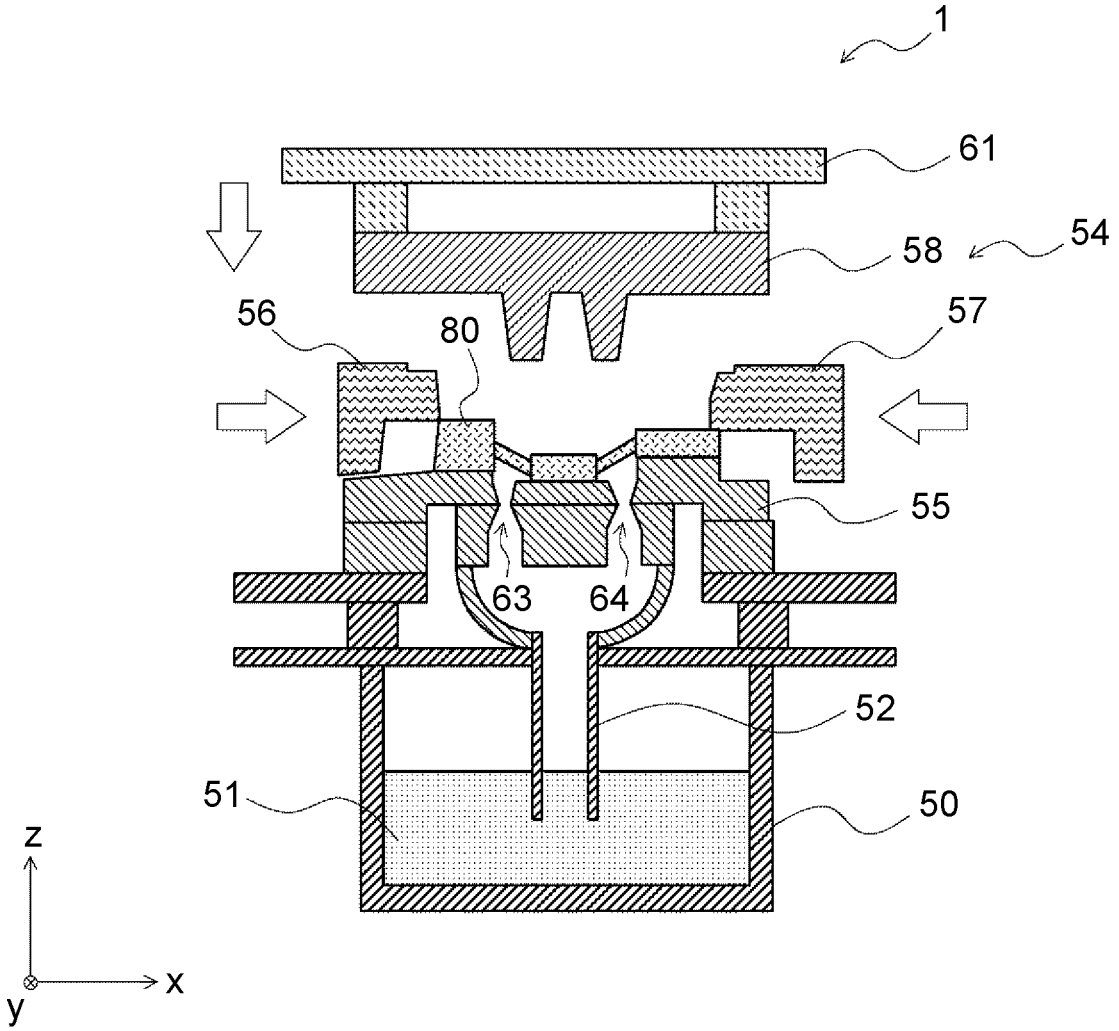
FIG. 9J is a sectional view illustrating the casting process using the casting apparatus according to the embodiment.

Then, as shown in FIG. 9J, the mold 54 is closed by moving the lateral mold segment 56 toward the plus side in the x-axis direction, the lateral mold segment 57 toward the minus side in the x-axis direction, and the upper mold segment 58 toward the minus side in the z-axis direction. Subsequently, the actions shown in FIG. 9A to FIG. 9J can be repeated to repeatedly perform casting using the casting apparatus 1.

Of the drawings described above, FIG. 9A to FIG. 9C correspond to a casting step; FIG. 9D corresponds to a mold opening step; FIG. 9E and FIG. 9F correspond to a core placing step; and FIG. 9G and FIG. 9H correspond to a casting receiving step. The case where the transfer device 10 receives the casting 30 after placing the core 80 in the lower mold segment 55 has been described above. Alternatively, in this embodiment, the transfer device 10 may place the core 80 in the lower mold segment 55 after receiving the casting 30. However, if the transfer device 10 receives the casting 30 after placing the core 80 in the lower mold segment 55 as described above, the core grasping mechanism 17 is spared the influence of the load of the casting 30 until the core 80 is placed. Thus, the operation accuracy of the core grasping mechanism 17 is secured, so that the positional accuracy in placing the core 80 can be secured.

As has been described above, in the casting apparatus according to this embodiment, the core grasping mechanism 17, i.e., the pickers 15 and the grasping parts 16, provided on the lower side of the support part 12 of the transfer device 10 is used to grasp the core 80, transfer the core 80 to above the lower mold segment 55, and place the core 80 in the lower mold segment 55. Moreover, the casting receiving part 14 provided on the upper side of the support part 12 of the transfer device 10 is used to receive the casting 30 held in the upper mold segment 58 and transfer the received casting 30 to the outside of the mold 54.

Thus, the casting apparatus 1 according to this embodiment can place the core 80 in the lower mold segment 55 and receive the casting 30 from the upper mold segment 58 as a sequence of actions. Therefore, the casting cycle time can be reduced. In particular, the casting apparatus 1 according to this embodiment can place the core 80 and receive the casting 30 without rotating the core grasping mechanism 17 and the casting receiving part 14, i.e., without turning them upside down. Therefore, the casting cycle time can be reduced.

In the related art, after a mold is opened (corresponding to FIG. 9D), a casting is released from an upper mold segment and transferred to an outside of the mold, and then a core is manually placed inside a lower mold segment. By contrast, the casting apparatus 1 according to this embodiment places the core 80 and receives the casting 30 by the transfer device 10. Thus, the casting process can be automated, and the core 80 can be placed in the lower mold segment 55 with high accuracy.

Figure 10:
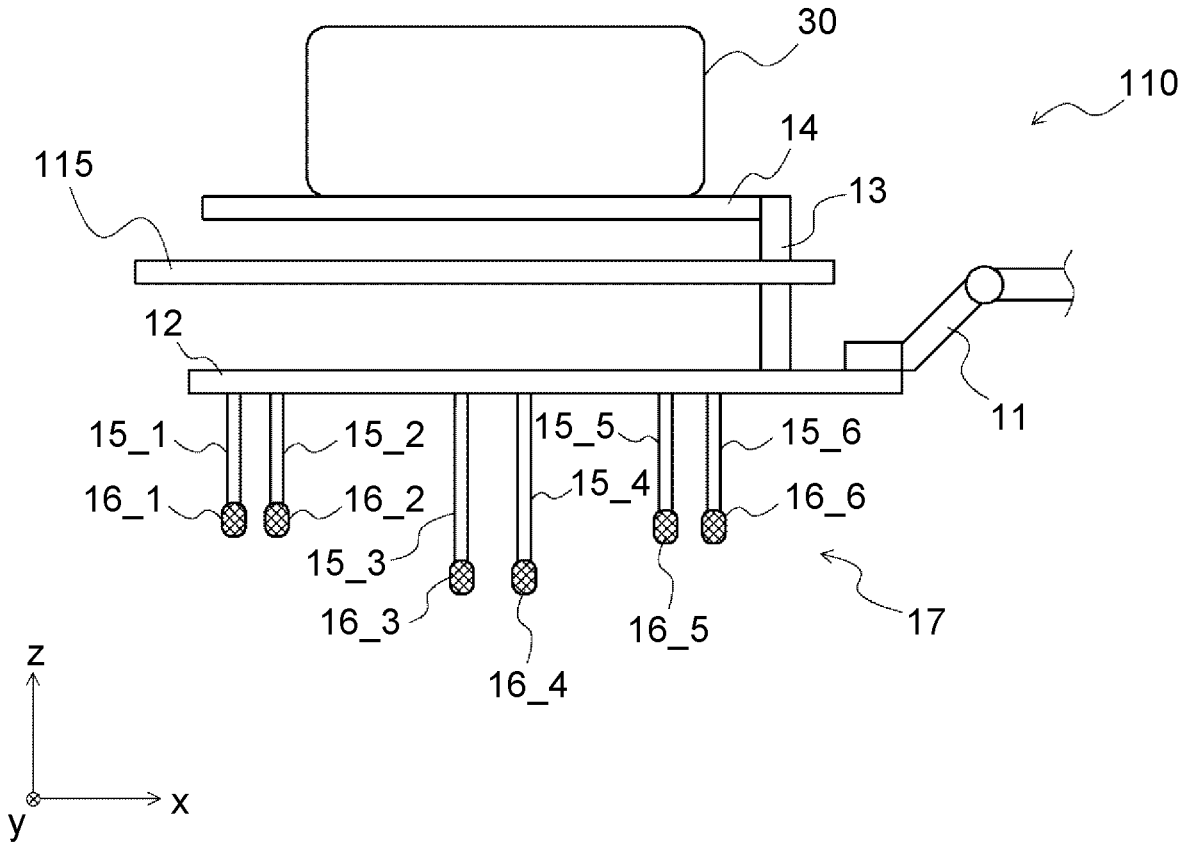
FIG. 10 is a front view showing another example of the configuration of the transfer device of the casting apparatus according to the embodiment.

Next, another example of the configuration of the transfer device will be described. FIG. 10 is a front view showing the other example of the configuration of the transfer device of the casting apparatus according to this embodiment. In this embodiment, as shown in FIG. 10, a sand receiving member 115 may be provided between the support part 12 and the casting receiving part 14 of a transfer device 110. The sand receiving member 115 is fixed to the column member 13 that extends upward from the upper surface of the support part 12. Thus, the sand receiving member 115 is formed by a plate member of which one end is supported by the column member 13 and which extends in the horizontal direction (the direction from the column member 13 toward the minus side in the x-axis direction).

The sand receiving member 115 receives sand falling from the core 20 that is contained in the casting 30 placed on the casting receiving part 14 (see FIG. 9H). In a direction perpendicular to the second side, the sand receiving member 115 may be located between the support part 12 and the casting receiving part 14. If the casting receiving part 14 is composed of the plurality of plate members 14_1, 14_2 as shown in FIG. 5, i.e., if the casting receiving part 14 has a fork shape, sand of the core 20 may fall through a gap between the plate members 14_1, 14_2. Since the transfer device 110 shown in FIG. 10 is provided with the sand receiving member 115 between the support part 12 and the casting receiving part 14, any sand of the core 20 falling from the casting receiving part 14 can be received by the sand receiving member 115. Thus, the sand can be prevented from falling onto the support part 12 or the core grasping mechanism 17.

While the present disclosure has been described above on the basis of the embodiment, alternatively, the core may be placed in the upper mold segment and the casting that has been cast may be held in the lower mold segment. It should be understood that the present disclosure is not limited to the configuration of the above embodiment but includes various changes, modifications, and combinations that can be implemented by those skilled in the art within the scope of the disclosure according to the claims.

What is claimed is:

1. A casting apparatus comprising:

a mold including a first mold segment and a second mold segment; and a transfer device that is configured to transfer a core to the first mold segment and place the core in the first mold segment, and to receive a casting that has been cast with the mold from the mold and transfer the casting, wherein the transfer device includes a support part including a first side and a second side that is an opposite side of the support part from the first side, a robot arm, a core grasping mechanism being provided on the first side, and a casting receiving part being provided on the second side, the casting is held in the second mold segment when the mold is opened after casting, the transfer device being configured such that, in a state where the mold is open, the robot arm moves the core grasping mechanism grasping the core so as to place the core in the first mold segment, and moves the casting receiving part so as to receive the casting held in the second mold segment, by the casting receiving part.

2. The casting apparatus according to claim 1, wherein the first mold segment is a lower mold segment and the second mold segment is an upper mold segment.

3. The casting apparatus according to claim 2, wherein the transfer device is configured such that, in a state where the mold is open, the robot arm moves the core grasping mechanism to a vertically upper side of the lower mold segment and moves the casting receiving part to a vertically lower side of the upper mold segment.

4. The casting apparatus according to claim 1, wherein the casting receiving part includes a column member including a first end and a second end, and a plurality of plate members, the first end is in contact with the second side, and the second end is located at a position away from the second side in a direction from the first side toward the second side, and the plurality of plate members each include one end in contact with the second end and another end, and the plurality of plate members are parallel to a plane of the support part, and the other ends of the plurality of plate members extend away from the second end in the same direction so as to form a fork shape.

5. The casting apparatus according to claim 4, wherein the transfer device includes a sand receiving member between the support part and the casting receiving part in a direction perpendicular to a plane of the second side, and the sand receiving member is configured to receive sand falling from the core that is contained in the casting placed on the casting receiving part.

6. The casting apparatus according to claim 1, wherein the casting receiving part includes a hole corresponding to a projection that is provided on a surface of the casting coming in contact with the first mold segment.

7. The casting apparatus according to claim 1, wherein the core grasping mechanism includes a picker that is in contact with the first side and extends in a direction from the second side toward the first side, the picker includes a grasping part configured to be expandable and contractible with a fluid, and the core grasping mechanism is configured to grasp the core by expanding the grasping part.

8. The casting apparatus according to claim 1, further comprising a holding furnace that is configured to hold molten metal, wherein the holding furnace is hermetically closed and communicates with an inside of the mold, and the holding furnace is configured such that the molten metal is supplied to the inside of the mold as a pressure inside the holding furnace is raised higher than an atmospheric pressure.

9. The casting apparatus according to claim 1, wherein the second mold segment includes a cooling mechanism that is configured to cool a molten metal packed inside the mold.

10. A casting method comprising:

separating a first mold segment of a mold and a second mold segment of the mold from each other after casting;

after separating the first mold segment and the second mold segment from each other, moving a support part including a core grasping mechanism grasping a core, by a robot arm so as to place the core in the first mold segment, the support part including a first side and a second side that is the opposite side of the support part from the first side, the core grasping mechanism being provided on the first side; and moving a casting receiving part provided on the second side, by the robot arm so as to receive a casting held in the second mold segment, by the casting receiving part.

11. The casting method according to claim 10, wherein the first mold segment is a lower mold segment and the second mold segment is an upper mold segment.

12. The casting method according to claim 11, wherein when placing the core in the lower mold segment, the robot arm moves the core grasping mechanism to a vertically upper side of the lower mold segment, and when receiving the casting by the casting receiving part, the robot arm moves the casting receiving part to a vertically lower side of the upper mold segment.

13. The casting method according to claim 10, wherein the casting is received by the casting receiving part after the core is placed in the first mold segment.

14. A casting apparatus comprising:

a mold including a first mold segment and a second mold segment; and a transfer device that is configured to transfer a core to the first mold segment and place the core in the first mold segment, and to receive a casting that has been cast with the mold from the mold and transfer the casting, the transfer device including:

a support part including a first side and a second side that is an opposite side of the support part from the first side, a robot arm, a core grasping mechanism being provided on the first side of the support part, the core grasping mechanism including a plurality of pickers and a plurality of graspers formed by an elastic member expandable and contractible with a fluid, and a casting receiving part being provided on the second side of the support part, the casting receiving part including a plurality of plate members connected to a column member, wherein:

the casting is held in the second mold segment when the mold is opened after casting, the transfer device being configured such that, in a state where the mold is open, the robot arm: (a) moves the core grasping mechanism grasping the core so as to place the core in the first mold segment, and (b) moves the casting receiving part so as to receive the casting held in the second mold segment by the casting receiving part.

15. The casting apparatus according to claim 14, wherein the first mold segment is a lower mold segment and the second mold segment is an upper mold segment.

16. The casting apparatus according to claim 14, wherein the casting receiving part includes a hole corresponding to a projection that is provided on a surface of the casting coming in contact with the first mold segment.

17. The casting apparatus according to claim 14, wherein the second mold segment includes a cooling mechanism that is configured to cool a molten metal packed inside the mold.

18. A casting method comprising:

separating a first mold segment of a mold and a second mold segment of the mold from each other after casting;

after separating the first mold segment and the second mold segment from each other, moving a support part including a core grasping mechanism grasping a core, by a robot arm so as to place the core in the first mold segment; and moving a casting receiving part by the robot arm so as to receive a casting held in the second mold segment by the casting receiving part, wherein:

the support part includes a first side and a second side that is the opposite side of the support part from the first side, the core grasping mechanism is provided on the first side of the support part, and the core grasping mechanism includes a plurality of pickers and a plurality of graspers formed by an elastic member expandable and contractible with a fluid, and the casting receiving part is provided on the second side of the support part, and the casting receiving part includes a plurality of plate members connected to a column member.

19. The casting method according to claim 18, wherein the first mold segment is a lower mold segment and the second mold segment is an upper mold segment.

20. The casting method according to claim 18, wherein the casting is received by the casting receiving part after the core is placed in the first mold segment.

* * * * *